US005414606A

United States Patent [19]

Weingärtner

[11] Patent Number: 5,414,606

[45] Date of Patent: May 9, 1995

[54] LIGHTING FIXTURE

[75] Inventor: Harald Weingärtner, Telfs, Austria

[73] Assignee: D. Swarovski & Co., Austria

[21] Appl. No.: 30,584

[22] Filed: Mar. 12, 1993

[30] Foreign Application Priority Data

Mar. 16, 1992 [DE] Germany ..... 42 08 410.5

[51] Int. Cl.[6] ..... F21V 3/00; F21V 7/02; F21P 1/02

[52] U.S. Cl. ..... 362/307; 362/328; 362/355; 362/455; 362/806

[58] Field of Search ..... 362/806, 355, 148, 299, 362/301, 328, 326, 455, 410, 347, 404, 327, 307

[56] References Cited

U.S. PATENT DOCUMENTS

| | | | |
|---|---|---|---|
| 1,178,537 | 5/1916 | Myatt | 362/328 |
| 2,007,528 | 7/1935 | Graham | 362/408 |
| 5,176,441 | 1/1993 | Horváth et al. | 362/455 |

FOREIGN PATENT DOCUMENTS

| | | | |
|---|---|---|---|
| 1051149 | 1/1954 | France | 362/806 |
| 358000 | 10/1921 | Germany | 362/455 |
| 3837797 | 5/1990 | Germany | 362/806 |
| 594493 | 6/1959 | Italy | 362/307 |
| 452009 | 8/1936 | United Kingdom | 362/307 |

*Primary Examiner*—Ira S. Lazarus
*Assistant Examiner*—L. Heyman
*Attorney, Agent, or Firm*—Fay, Sharpe, Beall, Fagan, Minnich & McKee

[57] ABSTRACT

A lighting fixture substantially comprising a lamp housing and an illuminant disposed therein, with a transparent decorative body being provided below the illuminant and spaced from the lamp housing, and a plate reflective on the side facing away from the illuminant and having a central bore being disposed between the illuminant and the decorative body.

17 Claims, 2 Drawing Sheets

LIGHTING FIXTURE

Figure 1:
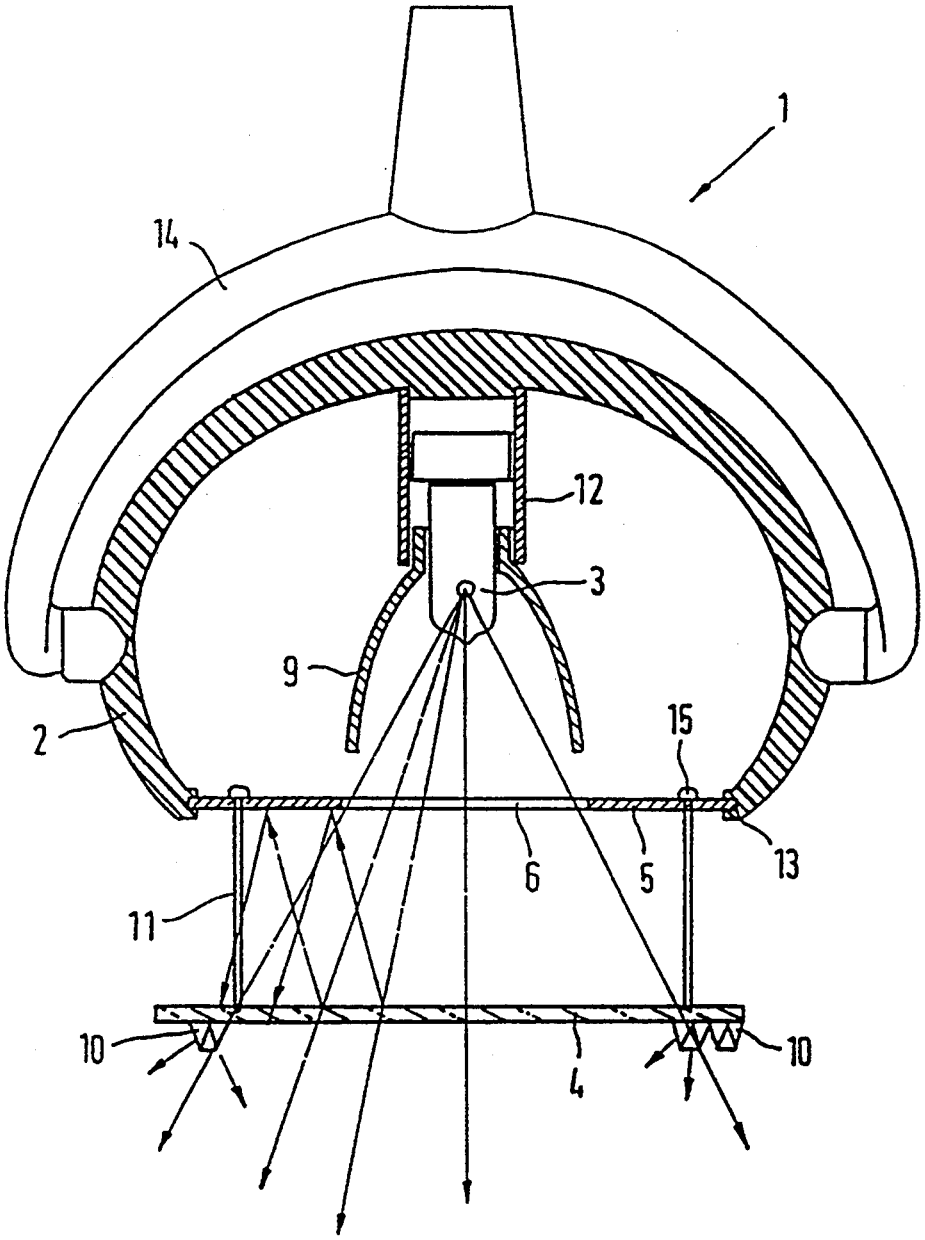

The present invention relates to a lighting fixture for uniformly illuminating special useful areas.

Lighting fixtures are used today to a large extent for illuminating useful architectural areas or business areas. Their design and construction are substantially aimed at obtaining high light efficiencies at a low expenditure of energy. Particularly in display rooms such lighting fixtures should also do justice to esthetic aspects while retaining their lighting quality. However the use of decorative elements on lighting fixtures frequently disturbs or even reduces the uniformity of the room illumination.

The present invention is therefore based on the problem of providing a lighting fixture that does equal justice to lighting engineering and esthetic aspects and ensures an improvement in the room illumination.

The idea of the invention is to solve this problem with a lighting fixture wherein the dispersive power of the decorative element used is increased.

The object of the present invention is a lighting fixture substantially comprising a lamp housing and an illuminant centrally disposed therein, with a transparent, light-dispersive decorative body being provided below the illuminant and spaced from the lamp housing, and a plate reflective on the side facing away from the illuminant and having a central bore being disposed between the illuminant and the decorative body.

The reflective plate provided between illuminant and decorative body causes the optical effect obtained by the decorative body to be obtained not only through the inner fraction of the light cone but also through the outer stray light fraction of the light cone which is located in the so-called scatter area. The dispersive power of the transparent, light-dispersive decorative body is increased by virtual reflections of the light beams on the reflective plate. The increase in dispersive power permits special esthetic light effects to be obtained. One simultaneously obtains a uniform and nonglare illumination of the useful plane.

Preferred embodiments of the inventive lighting fixture can be found in subclaims 2 to 11.

The reflective plate used is accordingly a mirror plate. This mirror plate bears a mirror layer on the side facing away from the illuminant, resulting in optimal virtual reflection of the light beams reflected by the light-dispersive decorative body.

The transparent, light-dispersive decorative body is further preferably a cut crystal glass plate, i.e. a glass plate with various planes of reflection or refraction. Such glass plates are easy and inexpensive to produce and have optimal properties with respect to light transmission, reflection and dispersion.

In a further preferred embodiment the glass plate is formed such that cut glass elements are fitted on its light exit side. The cut of the glass elements spectrally breaks up the light passing through the glass plate, resulting in special esthetic light effects involving varying iridescence. This effect is particularly pronounced with glass elements having a diamond cut. The glass elements may be chatons for example.

In a further preferred embodiment the decorative body also has a central bore through which the light emitted by the illuminant can exit without hindrance, in particular without deflection or interruption.

The illuminant used is preferably a low-voltage halogen lamp. It is furthermore favorable to use low-voltage lamps for reasons of energy technology.

In a further and particularly preferred embodiment of the present invention the illuminant is disposed in a reflector in the lamp housing. The reflector causes the light emitted by the light source to be focused on the bore in the reflective plate and thus on the light exit side of the decorative body. This avoids losses of light through undesirable scattering of the light within the lamp housing. In addition it produces a light cone exiting with no shadow. It is particularly suitable for the reflector to be of approximately elliptic and/or parabolic form. This also means that the reflector form can be selected in freely variable fashion in accordance with the light source used, the distance of the light exit bore or the distance of the transparent decorative body.

The inventive lighting fixture is designed in terms of structural engineering in particular in such a way that the reflective plate engages the lamp housing by means of a clamping joint and the decorative body is fastened to the reflective plate and spaced therefrom by means of connecting pins. This structure is technically easy to achieve and ensures a reliable hold of the reflective plate within the lamp housing. At the same time the decorative body can be easily connected with the rest of the lamp housing.

In a special embodiment of the present invention the connecting pins are lengthwise adjustable so that the decorative body can be disposed at different distances from the reflective plate depending on the requirements.

In the following the inventive lighting fixture shall be explained with reference to schematic drawing FIGS. 1 and 2.

Figure 2:
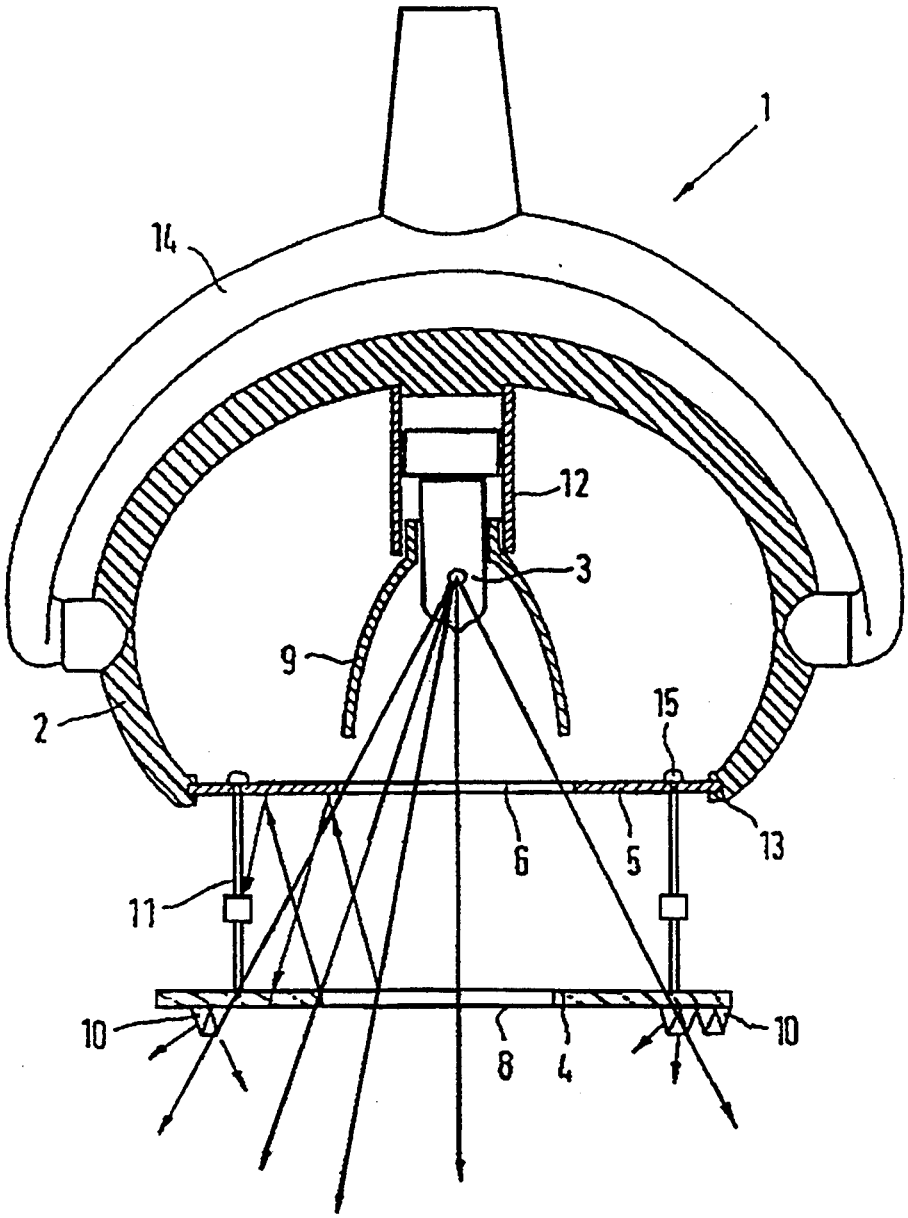

In drawing FIG. 1, reference number 1 refers to the inventive lighting fixture in a special embodiment.

Lighting fixture 1 has lamp housing 2 with fastening sleeve 12 provided in the center. Fastening sleeve 12 contains illuminant 3 as well as reflector 9. In the embodiment shown, illuminant 3 is a low-voltage halogen lamp. On the open side of lamp housing 2 groove 13 is provided in the lowest edge area. Groove 13 is for nonpositive connection of the lamp housing with inventively provided reflective plate 5. However the reflective plate can be connected with the lamp housing in any conventional way. For example it can be screwed thereto. Reflective plate 5 has central bore 6 through which the light emitted by the illuminant can exit. Plate 5 is reflective on the side facing away from the illuminant, but it can also be reflective on both sides. In the embodiment shown, this is obtained by a mirror plate. Spaced from reflective plate 5 is transparent decorative body 4 which is connected with reflective plate 5 by means of connecting pins 11. In this embodiment decorative body 4 bears cut glass elements such as chantons 10 on its underside, i.e. the light exit side.

It is also expedient to design the lighting fixture, as shown, so that it is connected via lamp housing 2 with mechanical receiving means 14 which holds said housing in swiveling or rotatable fashion. No claims are raised in the context of the invention on the form of this mechanical receiving means shown in the drawing. It is merely intended for simple representation.

Lamp housing 2 can be made of the customary materials such as metal and plastic. However it is preferable for safety reasons to use materials which do not conduct electricity, for example plastic. If the lamp housing is visible in use, decorative coatings can be provided.

Fastening sleeve 12 is provided as a seat for illuminant 3 and is therefore connected with the current supply. If a simple light bulb is used as illuminant 3, fastening sleeve 12 is formed with a socket seat, i.e. a screw means. In the lower area of fastening sleeve 12 there is receiving means 14 for reflector 9. It is expedient to provide an insulating layer in the lower area of fastening sleeve 12 if the latter is made of electroconductive material. Fastening sleeve 12 can be connected or connectible with lamp housing 2 in a great variety of ways. Suitable connections are produced by soldering, gluing or screwing.

Reflector 9 has a parabolic cross section in the embodiment shown. The constructional design of reflector 9 is variable, however, and should be contingent in the context of the invention in particular on the light source used and on the other constructional features of lighting fixture 1. Reflector 9 can be made of the customary materials. An IR-vaporized glass reflector is preferably used.

Reflective plate 5 can fundamentally be made of any material provided with a suitable reflective layer. A mirror-coated plate, i.e. a silver-vaporized plate, preferably a silver-vaporized glass plate, is particularly suitable for technical/optical reasons and with respect to the intended virtual reflection.

The transparent, light-dispersive decorative body can likewise be made of the customary transparent materials, for example acrylic resin. However it is preferable in the context of the invention to use a glass plate provided with cut glass elements on its bottom surface, i.e. the light exit surface. These glass elements can be disposed on the decorative body in many different arrangements and in ornamental fashion depending on the desired esthetic effect. In the context of the invention it is preferable to use cut glass elements with a corresponding carrier plate, or glued crystals or cut single crystal members. These glass elements are glued to the carrier plate by means of transparent adhesive. Instead, single crystal members can also be used for the decorative body.

The decorative body can be set with the cut glass elements either altogether or only in groups. It can also have, as shown in FIG. 2, a central bore 8 for direct exit of light.

Connecting pins 11 between transparent plate 5 and decorative body 4 can be provided, as shown, in such a way that they extend through bores in reflective plate 5 and are locked thereon by means of rivets 15, and are glued to the decorative body for esthetic reasons. It is also conceivable for connecting pins 11 to be glued both to transparent plate 5 and to decorative body 4. If as shown in FIG. 2, the connecting pins 11 are lengthwise adjustable one can vary the distance between the decorative body and the reflective plate or the lamp housing. The further away the decorative body is, the more light can exit laterally, and vice versa.

Reflective plate 5 causes light beams that would be reflected by the decorative body into lamp housing 2, involving a loss of emerging light, to be virtually reflected on the reflecting plate. This in particular utilizes the outer stray light fraction of the emerging light cone and has it spectrally decomposed by the crystal decorative body. This altogether increases the dispersive power of the crystal decorative body.

The inventive lighting fixture is not limited to the embodiment shown. It is in particular conceivable to use a normal illuminating system without a reflector or without a low-voltage halogen lamp. In any case an optimal, uniform and non-glare illumination of the useful area is ensured. The individual constructional features described depend primarily on the type of useful plane to be illuminated and the desired effects to be obtained.

I claim:

1. A lighting fixture (1) comprising a lamp housing (2) and an illuminant (3) disposed therein, wherein below the illuminant (3) in a direction of light radiation and a distance from the lamp housing (2) a light-dispersive decorative body (4) is provided, and a plate (5) with a central bore (6) is arranged between the illuminant (3) and the decorative body (4), characterized in that the decorative body (4) is in a form of one of a cut plate and a plate covered with cut glass elements (10) and that the plate (5) with the central bore (6) is reflective on the side facing away from the illuminant.

2. The lighting fixture of claim 1, characterized in that the plate (5) is a mirror plate.

3. The lighting fixture of claim 1, characterized in that the decorative body (4) is a cut crystal glass plate.

4. The lighting fixture of claim 3, characterized in that the decorative body (4) is a glass plate which is set on a light exit side with cut glass elements (10).

5. The lighting fixture of claim 4, characterized in that the cut glass elements (10) are chatons.

6. The lighting fixture of claim 1, characterized in that the decorative body (4) has a central bore (8).

7. The lighting fixture of claim 1, characterized in that the illuminant (3) is a low-voltage halogen lamp.

8. The lighting fixture of claim 1, characterized in that the illuminant (3) is disposed in a reflector (9) in the lamp housing (2).

9. The lighting fixture of claim 8, characterized in that the reflector is approximately at least one of elliptic and parabolic.

10. The lighting fixture of claim 1, characterized in that the reflective plate (5) engages the lamp housing (2) by means of a clamping joint, and the decorative body (4) is fastened to the reflective plate (5) by means of connecting pins.

11. The lighting fixture of claim 10, characterized in that the connecting pins are lengthwise adjustable.

12. The lighting fixture of claim 2, characterized in that the decorative body (4) is a cut crystal glass plate.

13. The lighting fixture of claim 2, characterized in that the decorative body (4) has a central bore (8).

14. The lighting fixture of claim 2, characterized in that the illuminant (3) is a low-voltage halogen lamp.

15. The lighting fixture of claim 2, characterized in that the illuminant (3) is disposed in a reflector (9) in the lamp housing (2).

16. The lighting fixture of claim 2, characterized in that the reflective plate (5) engages the lamp housing (2) by means of a clamping joint, and the decorative body (4) is fastened to the reflective plate (5) by means of connecting pins.

17. A lighting fixture comprising:

a lamp housing having a lower edge area;

an illuminant disposed within the lamp housing;

a reflective plate connected to the lamp housing such that the reflective plate is located at the lower edge area of the lamp housing spaced a distance from the illuminant, the reflective plate having a first side and a second side, at least the second side having reflective material thereon, said second side facing away from said illuminant, said reflective plate further including a central bore area; and a transparent decorative body connected to the reflective plate a distance from the reflective plate, the transparent decorative body having a first side and a second side, the first side of the transparent decorative body facing the second side of the reflective plate.

* * * * *